US006361186B1

(12) United States Patent
Slayden

(10) Patent No.: US 6,361,186 B1
(45) Date of Patent: Mar. 26, 2002

(54) SIMULATED NEON LIGHT USING LED'S

(75) Inventor: James C. Slayden, Talala, OK (US)

(73) Assignee: Lektron Industrial Supply, Inc., Tulsa, OK (US)

( * ) Notice: Subject to any disclaimer, the term of this patent is extended or adjusted under 35 U.S.C. 154(b) by 0 days.

(21) Appl. No.: 09/632,032

(22) Filed: Aug. 2, 2000

(51) Int. Cl.[7] ..... F21V 21/00

(52) U.S. Cl. ..... 362/249; 362/251; 362/231; 362/545; 362/800; 362/361; 362/363; 362/219; 362/240

(58) Field of Search ..... 362/249, 351, 362/231, 545, 240, 223, 800, 361, 363, 219

(56) References Cited

U.S. PATENT DOCUMENTS 4,858,088 A * 8/1989 Agabekov ..... 362/249
5,343,375 A * 8/1994 Gross ..... 362/248
6,158,882 A * 12/2000 Bischoff, Jr. ..... 362/488

* cited by examiner

*Primary Examiner*—Thomas M. Sember
*Assistant Examiner*—Ali Alavi

(74) *Attorney, Agent, or Firm*—Frank J. Catalano

(57) ABSTRACT

A neon light is simulated using light emitting diodes as a light source. An elongated, translucent diffuser of circular cross-sections is mated with an elongated opaque tubular housing of constant cross-section with a lengthwise slot. The diffuser is held in longitudinally aligned abutment against the edges of the housing slot to form a chamber between the housing and the diffuser from which light may only be emitted through the diffuser. A plurality of light emitting diodes is aligned in a linear array in the chamber. The reflection and refraction of light by the tubular diffuser produces a neon-like glow or glare along the exposed surface of the diffuser. The housing has a maximum width not greater than the diameter of the diffuser, so that the housing is hidden behind the diffuser. The diodes may be electrically connected in patterns of alternating sequential activation to give a flashing, mono-chromatic effect and may be color coded according to the patterns of alternating sequential activation to give a flashing, color changing effect to the fixture. Preferably, the housing is sufficiently resiliently flexible to permit the diffuser to be disengaged from and reengaged with the housing so as to permit maintenance of the fixture without removal from its location. This LED simulation affords a durable, low voltage, low energy, non-gaseous, inexpensive, easy to install, easy to maintain, chromatically versatile, long life fixture which looks like neon light and demands the attention of the observer.

20 Claims, 4 Drawing Sheets

SIMULATED NEON LIGHT USING LED'S

BACKGROUND OF THE INVENTION

This invention relates generally to lighting equipment and more particularly concerns a fixture using light emitting diodes to simulate a neon light.

Neon lights are widely used in commercial applications as decorative enhancements, information communicators and back lights. For example, they are used to highlight architectural features or to display names, logos and the like.

Neon lights are generally chosen for their neon affect or glare which demands the viewer's attention. This ability to draw attention outweighs the many drawbacks associated with neon lights. They are fragile, high voltage, energy consuming, monochromatic devices with inconsistent life patterns. They are labor intensive and require licensed tradesmen for installation and replacement. From a practical standpoint, any other type of lighting would be desirable if it could produce the attention demanding impact associated with neon.

It is, therefore, an object of this invention to provide a simulated neon light which is durable. Another object of this invention is to provide a simulated neon light which operates at low voltages. A further object of this invention is to provide a simulated neon light which conserves energy. It is also an object of this invention to provide a simulated neon light which is easy to install. Still another object of this invention is to provide a simulated neon light which is easy to maintain. An additional object of this invention is to provide a simulated neon light which is long lasting. Yet another object of this invention is to provide a simulated neon light which is non-monochromatic. A further object of this invention is to provide a simulated neon light which is inexpensive.

SUMMARY OF THE INVENTION

In accordance with the invention, a neon light is simulated using light emitting diodes as a light source. An elongated, translucent diffuser of circular cross-section is mated with an elongated opaque tubular housing of constant cross-section with a lengthwise slot. The diffuser is held in longitudinally aligned abutment against the edges of the housing slot to form a chamber between the housing and the diffuser from which light may only be emitted through the diffuser.

A plurality of light emitting diodes is aligned in a linear array in the chamber. The plurality of diodes is connected to an electrical power source for energizing the diodes. The light emitted from the diodes can only pass from the chamber into the wall of the diffuser along the slot and out of the wall of the diffuser outside of the housing. The refraction and reflection of light by the tubular diffuser produces a neon-like glow or glare with an appearance of substantially homogeneous light intensity across the exposed surface of the diffuser. The housing has a maximum width taken in a direction parallel to a plane traversing the slot which is not greater than the diameter of the diffuser, so that the housing is hidden behind the diffuser. The diffuser is preferably made of polyethylene, but any material having an index of refraction in a range of that of polyethylene can be used.

In an alternative embodiment, the diffuser has a lengthwise slot contiguous with the housing slot, so that the light from the diodes is refracted and reflected over more than a 180 degree arc of the diffuser. However, the diodes do not physically penetrate within the circumference of the diffuser.

This spacing of the diodes from the interior of the diffuser minimizes the appearance of point source intensity in the diffuser. It may be desirable in this embodiment to further soften the dispersion of light by use of wide angle light dispersing diodes. The diodes may all be of the same color. The diodes may be electrically connected in patterns of alternating sequential activation to give a flashing, monochromatic effect. The diodes may be color coded according to the patterns of alternating sequential activation to give a flashing, color changing effect to the fixture. A translucent color coating can be applied to the exposed exterior display surface of the diffuser to enhance the color of the diodes in monochromatic applications.

The diffuser and housing may be held together by an adhesive bond, or, preferably, by mating channels and flanges extending lengthwise on the diffuser and the housing. Preferably, the housing is sufficiently resiliently flexible to permit the diffuser to be disengaged from and reengaged with the housing so as to permit maintenance of the fixture without removal from its location.

The diodes are preferably fixed to a circuit board and the housing is provided with channels for engagement of the edges of the circuit board to hold the diodes in position in the chamber. In this configuration, the housing is preferably sufficiently resiliently flexible to permit the circuit board to be disengaged from and reengaged with the housing, again to facilitate maintenance without removal of the fixture from its location. Alternatively, interior flanges may be provided on each side of the housing on which the board can be seated, and plastic spring clips used to pin the boards between the flanges and the channels along the housing slot.

This light emitting diode simulation of a neon light affords all of the advantages of LED lighting. It provides a durable, low voltage, low energy, non-gaseous, inexpensive, easy to install, easy to maintain, chromatically versatile, long life fixture which looks like a neon light and demands the attention of the observer.

BRIEF DESCRIPTION OF THE DRAWINGS

Other objects and advantages of the invention will become apparent upon reading the following detailed description and upon reference to the drawings in which.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION

Figure 1:
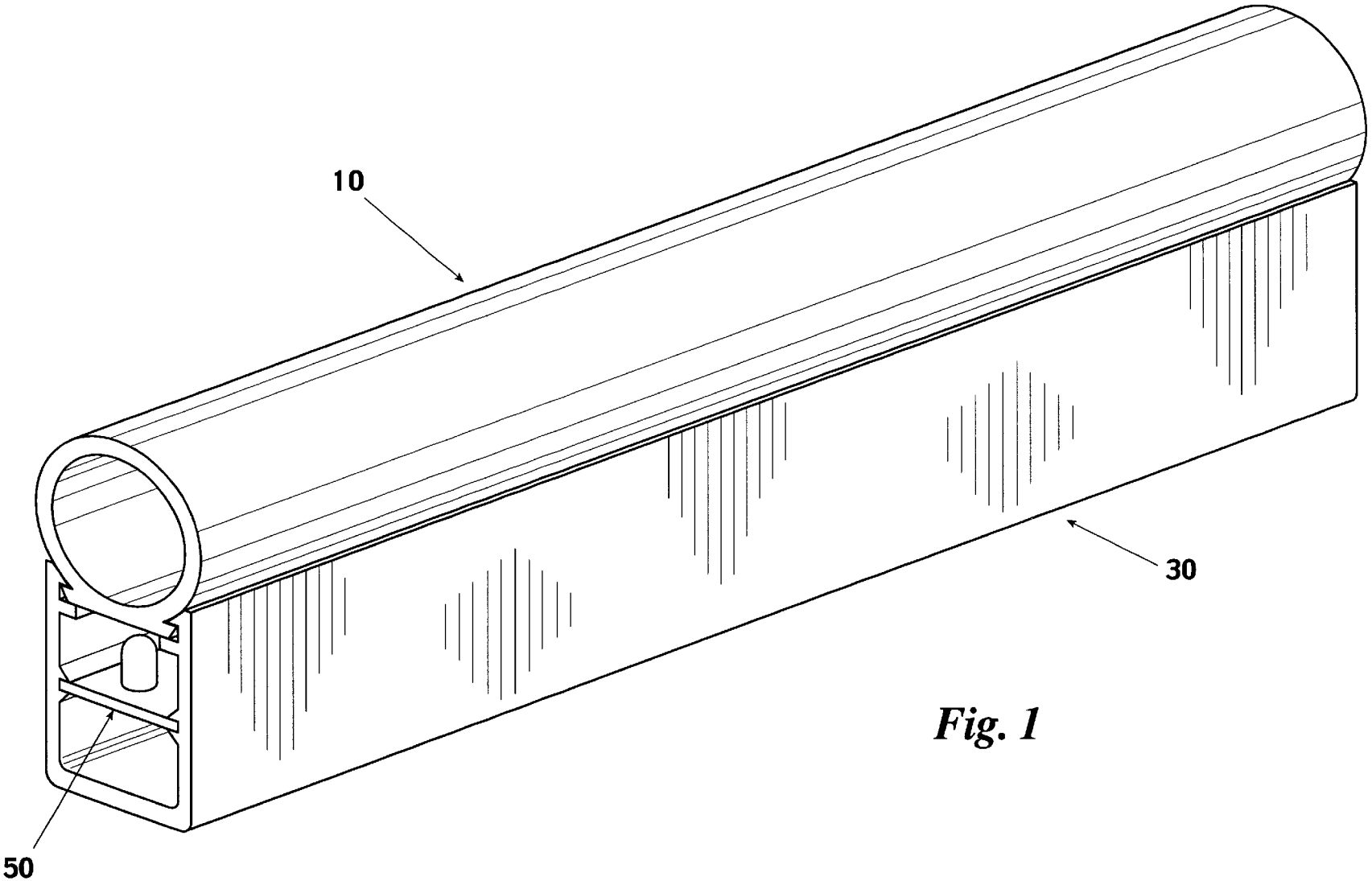
FIG. 1 is a perspective view of a preferred embodiment of a simulated neon light using light emitting diodes as a light source.

Turning to FIG. 1, a simulated neon light includes an elongated translucent diffuser 10, an elongated opaque tubular housing 30 and a light emitting diode circuit board 50.

A first embodiment of the diffuser 10 is illustrated in FIG. 1. The diffuser 10 consists of a tube 11 having a circular cross section. A pair of flanges 13 and 15 are symmetrically oppositely displaced in relation to a diameter 17 of the tube 11 and extend outwardly from the outer wall of the tube 11 parallel to a plane 19 perpendicular to the diameter 17. Preferably, the flanges 13 and 15, taken together, define a planar surface 19 which is tangent to the outer wall of the tube 11. The flanges 13 and 15 extend lengthwise on the diffuser. Preferably, the diffuser is made of polyethylene and most preferably of a milky clear polyethylene, though other materials having an index of refraction approximately equal to that of polyethylene may also be used. As shown, it is preferred that the ends of the flanges 13 and 15 are tapered so that the cross-sectional distances across the flanges 13 and 15 is at a minimum at the furthermost point from the center 21 of the tube 11. In a prototype light, a tube 11 of milky clear polyethylene having a 0.675 inch inner diameter and a 0.9 inch outer diameter is provided with 0.075 inch thick flanges 13 and 15. The longest width across the flanges 13 and 15 is 0.675 inches or equal to the inner diameter of the tube 11. The ends of the flanges 13 and 15 are tapered at approximately 45 degrees to the shortest width across the flanges 13 and 15, the shortest width being tangent to the outer wall of the tube 11.

Figure 3:
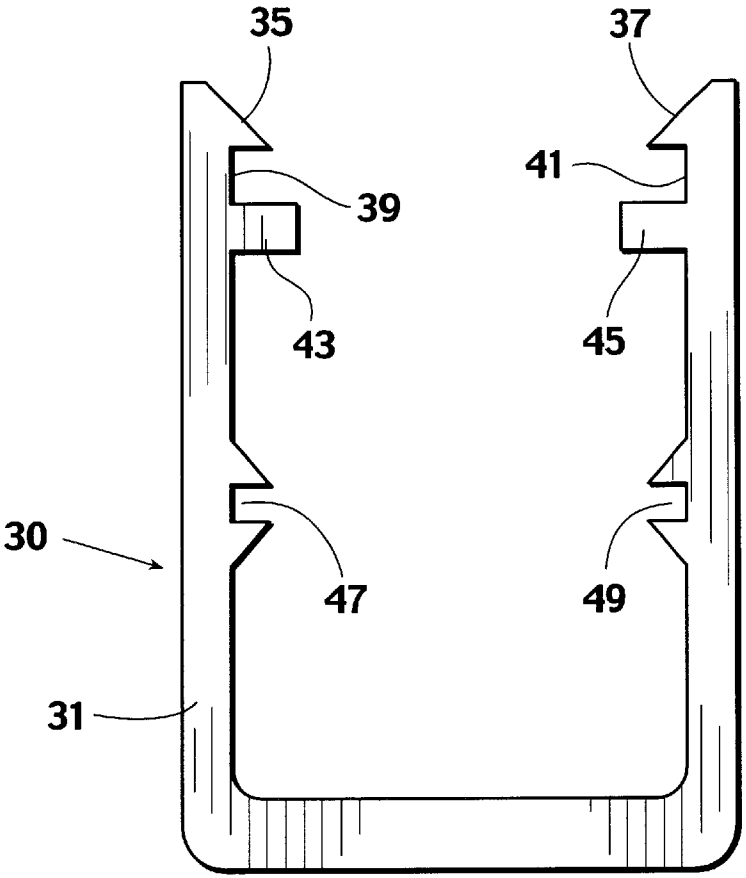
FIG. 3 is an end elevation view of the housing of the light of FIG. 1.

Looking at FIG. 3, in a first embodiment of the housing 30, a tubular member 31 has a constant cross-section with a lengthwise slot 33. As shown, the tubular member 31 is substantially rectangular and the slot 33 extends through a short wall of the rectangular cross-section. The inside edges 35 and 37 of the slot 33 are tapered to narrow the slot 33 toward the interior of the housing 30. Immediately below the tapered slot 33 are lengthwise opposing channels 39 and 41 between the narrow ends of the tapered slot 33 and a pair of flanges 43 and 45 which extend lengthwise on opposite inside walls of the tubular member 31. Similarly, lengthwise opposed channels 47 and 49 extend along the longer inside walls approximately at their midpoint or along a plane closer to the short wall of the rectangular cross-section in which no slot is provided. As shown, the inside walls of the tubular member 31 are tapered inwardly to form the channels 47 and 49. In the prototype light, the rectangular cross-section housing consists of a flat black opaque tube having outer dimensions of 1.35 inches by 0.825 inches with short walls of approximately 0.1 inch thickness and long walls of approximately 0.075 inch thickness. The channels 39, 41, 47 and 49 are approximately 0.075 inches in depth with the second set of channels 47 and 49 being approximately ½ inch from the unslotted short wall of the housing 30. Other cross-sections than rectangular could be used for the housing 30, provided the housing 30 has a maximum width which, taken in a direction parallel to a plane traversing the slot 33, is not greater than the diameter of the diffuser 10. Thus, the housing 30 can be hidden behind the diffuser 10.

Figure 2:
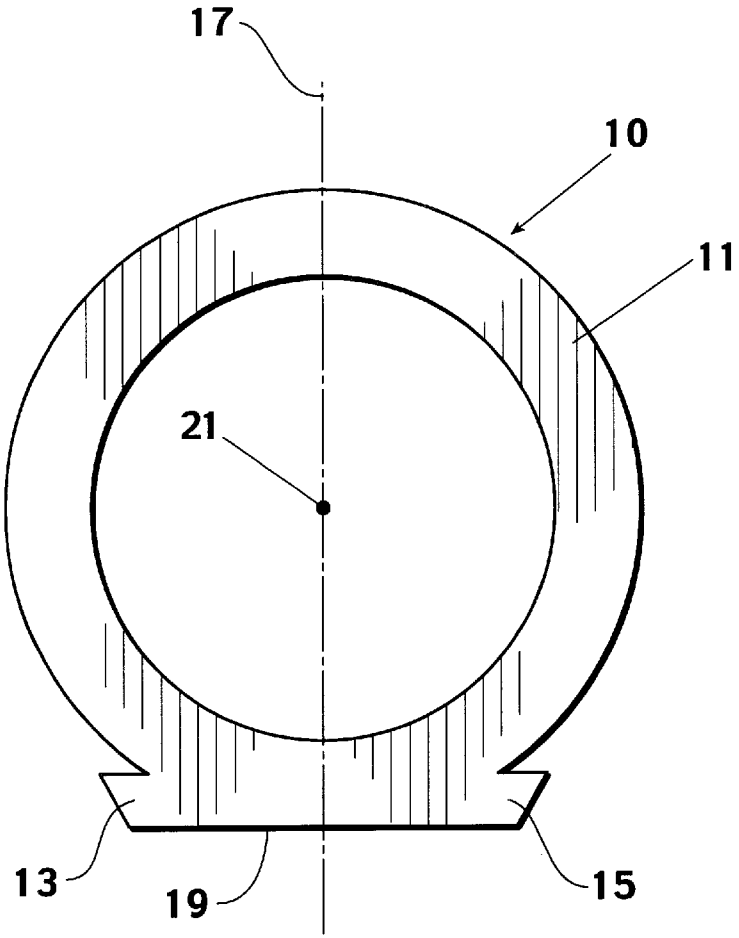
FIG. 2 is an end elevation view of the diffuser of the light of FIG. 1.
Figure 4:
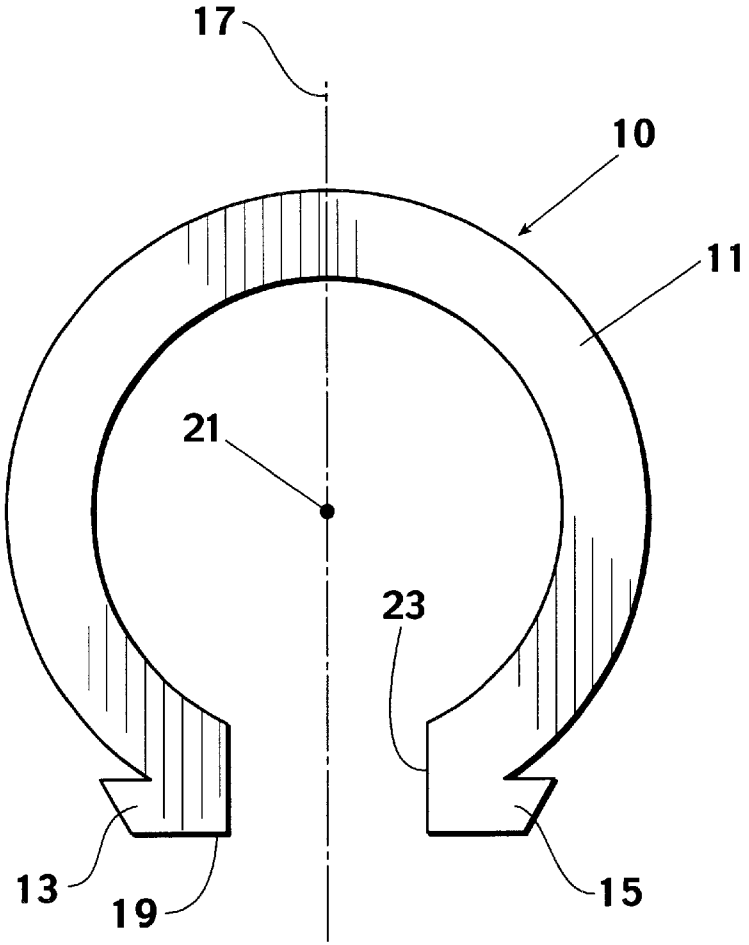
FIG. 4 is an end elevation view of an alternative embodiment of the diffuser.

Looking at FIG. 4, an alternate embodiment of the diffuser 10 is illustrated which is in all respects the same as the diffuser 10 illustrated in FIG. 2 except that the circular tube 11 is provided with a lengthwise slot 23 through the tube 11 and the flanges 13 and 15. The slot is symmetrically disposed in relation to the diameter 17 which is perpendicular to the plane 19 of the flanges 13 and 15.

Figure 5:
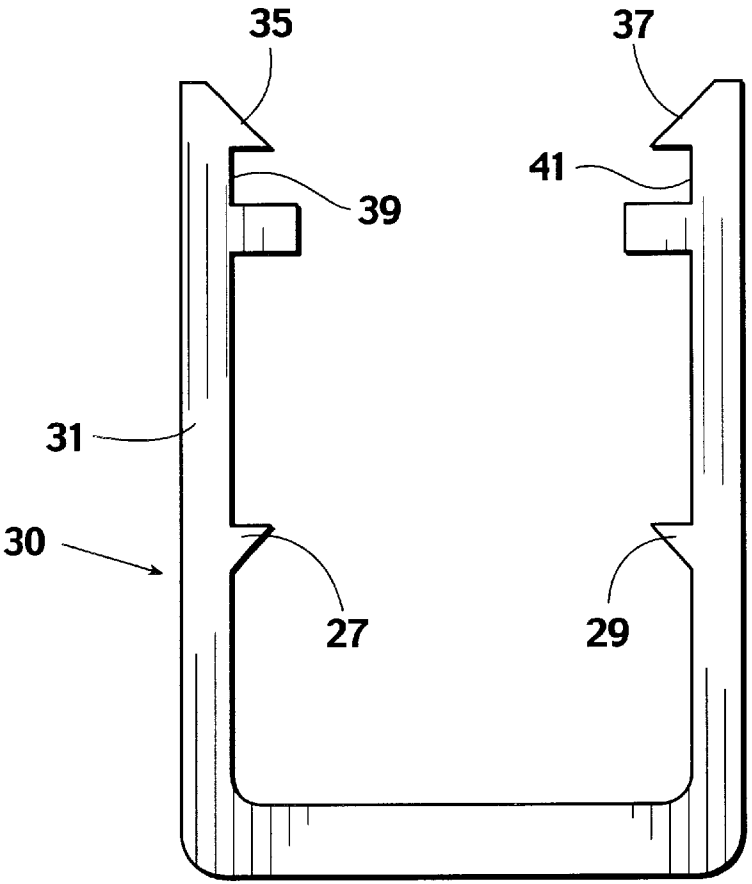
FIG. 5 is an end elevational view of an alternative embodiment of the housing.

FIG. 5 illustrates an alternate embodiment of the housing 30. The housing 30 of FIG. 3 is identical in all respects to the housing 30 of FIG. 5 except that the channels 47 and 49 have been replaced by flanges 27 and 29 which are oppositely disposed lengthwise along the inside walls of the tubular member 31.

Figure 6:
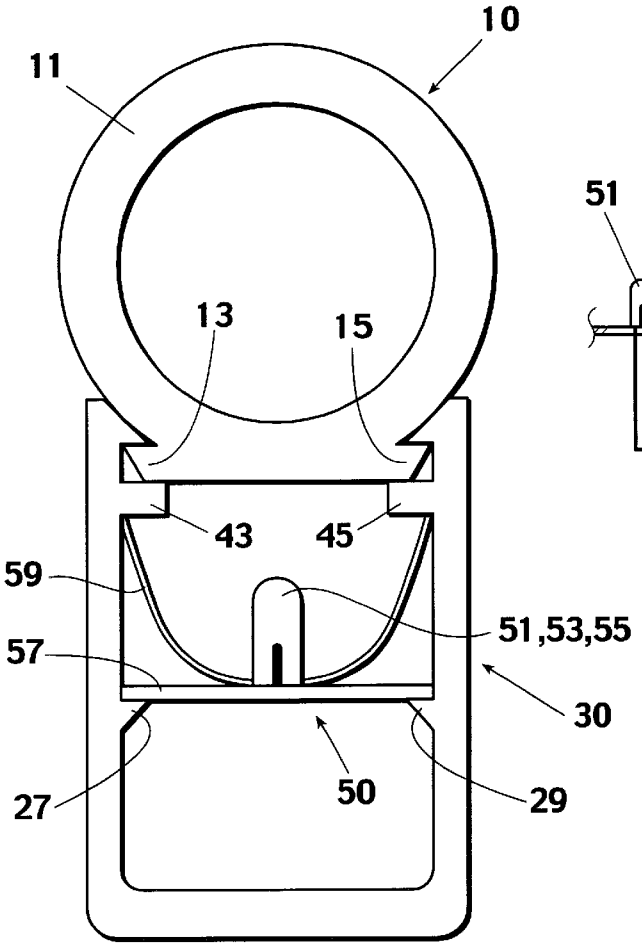
FIG. 6 is a cross-sectional view illustrating the combination of the diffuser of FIG. 2 with the housing of FIG. 5.

In the embodiment of the housing 30 illustrated in FIGS. 5 and 6, a circuit board 57 is seated on the flanges 27 and 29. A spring clip 59, consisting of a thin, narrow strip of resiliently flexible plastic, is cooperable with the housing 30 to hold the circuit board 57 against the flanges 27 and 29. As shown, the length of the spring clip 59 is chosen so that when its ends are engaged against the flanges 43 and 45 of the housing, its central portion bears against the circuit board 57. For a lamp dimensioned in accordance with the prototype herein described, spring clips consisting of 1¼ inch lengths of 0.2 inch wide plastic would be suitable with one or two clips used for each section of circuit board, the clips being disposed between the light emitting diodes.

Figure 7:
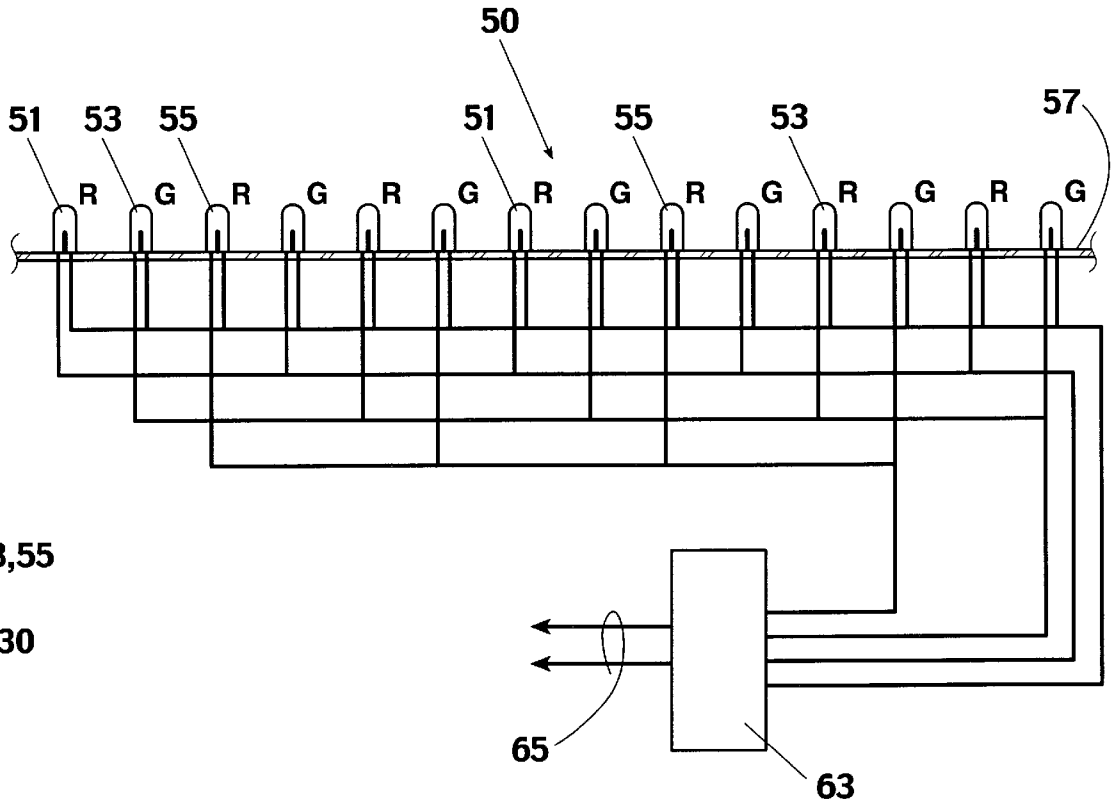
FIG. 7 is a wiring diagram for the simulated neon light illustrating a multicolor application of the invention.

Looking at FIGS. 5, 6 and 7, the light source for the simulated neon light consists of a plurality of light emitting diodes 51, 53 and 55 aligned in a linear array on the circuit board 57. In the prototype, a circuit board 57 holding thirty diodes per foot on ⅜ inch centers with every third diode 51, 53 and 55 connected in a common circuit is used. For the embodiment of the housing 30 shown in FIGS. 1 and 3, the circuit board 57 has its opposite edges engaged in the channels 47 and 49 of the housing 30. As best seen in FIG. 3, in this embodiment, the taper of the housing wall to the channels 47 and 49 facilitates the pressing of the circuit board 57 into the channels, the housing 30 being sufficiently resiliently flexible to receive the circuit board 57 and the channels 47 and 49 so as to permit the circuit board 57 to be disengaged from and reengaged with the housing 30.

Looking at FIGS. 1 and 6, once the circuit board 57 is mounted in the housing 30, the diffuser 10 can be mounted. As shown, the flanges 13 and 15 on the diffuser 10 engage in the channels 39 and 41 of the housing 30. As best seen in FIG. 6, when the tapered ends of the flanges 13 and 15 on the tubular member are pressed into the tapered edges 35 and 37 of the slot 33 on the housing 30, the resilient flexibility of the housing 30 allows the flanges 13 and 15 of the diffuser 10 to snap into the channels 39 and 41 of the housing 30. Thus, the resilient flexibility of the housing 30 permits the diffuser 10 to be disengaged from and reengaged with the housing 30.

As is best seen in FIG. 6, the diffuser 10 is held in longitudinally aligned abutment against the edges 35 and 37 of the slot 33 in the housing 30 to form a chamber 61 between the housing 30 and the diffuser 10. Since the housing 30 is opaque, light can only be emitted by the diodes 51, 53 and 55 through the diffuser 10. Since the diodes 51, 53 and 55 are external to the outer diameter of the diffuser 10, refracted light can be emitted from the fixture only after being twice refracted by the diffuser 10. In addition, the inner and outer walls of the diffuser 10 provide reflective light throughout the cross-section of the tube 11. It is believed that this combination of reflected and refracted light in the translucent tube is what affords the neon-like glow of the fixture. In the slotted embodiment of the diffuser 10 illustrated in FIG. 4, the slot 23 is aligned contiguously with the slot 33 in the housing 30. This may somewhat reduce the quality of neon simulation, but does facilitate assembly and maintenance since the diffuser 10 is thus compressible to assist in engagement with the channels 39 and 41 of the housing 30. The reduced quality of neon simulation, if any, appears as variations in intensity of light on the exposed diffuser surface due to the use of multiple point sources of light. This potential loss of quality can be minimized by use of wider angle dispersion light emitting diodes. The wider angle of dispersion not only directly reduces the focused intensity of the point sources but also adds to the refractive and reflective qualities of the diffuser 10.

Looking at FIG. 7, it can readily be seen that diodes of the same color can be used to provide monochromatic light. However, if, as shown, the diodes are electrically connected in patterns of alternating sequential activation, then the lamp can be caused to flash or be configured to be nonmonochromatic. For example, a circuit controller 63 connected between the simulated neon light and the power source 65 can be switched to select the mode of operation of the light. If the diodes 51, 53 and 55 are identically colored and all circuits function at all times, a constant monochromatic light will result. If the controller 63 simultaneously connects and disconnects all of the circuits, then a flashing monochromatic light will result. If the controller 63 sequentially connects and disconnects the circuits, the emitted light can appear to move in waves across the fixture. If the diodes 51, 53 and 55 are color coded according to the patterns of alternating sequential activation, for example red R, green G and blue B, the sequential operation of the circuits by the controller 63 will result in a sign which changes colors according to the sequenced pattern. In addition, by the use of opaque dividers between sections of a fixture, the dividers sealing a cross-section through both the diffuser 10 and the housing 30, a light having sections of different colors can be devised.

Preferably, the lights will be constructed in modular lengths, such as one, two, four, eight feet and so on, though any length or multiple of lengths can be chosen. Alternatively, long lengths of light can be cut to any desired length. In addition, connectors of a wide range of angles may be used to interconnect straight modules into a desired configuration. For example, four 90 degree connectors can be used to connect four straight modules into an "O" configuration. While the housing 30 may be of any desired length, it is especially preferred that the diffuser 10 be provided in segments of five feet or less so that a section of diffuser 10 can be removed from a housing 30 to permit maintenance of the diodes and circuit board without removal of the fixture from its location. However, for long lengths of diffuser 10, it is anticipated that the diffuser 10 will be sufficiently flexible so as to permit a portion of the diffuser to be disengaged from the housing 30 without disengagement of the remainder of the diffuser 10 from the housing 30.

While the diffuser 10 is preferably milky clear, the diffuser can be color coded to coordinate with diode color or a translucent coat coordinated with the color of the diodes may be applied to the outer surface of the diffuser.

Thus, it is apparent that there has been provided, in accordance with the invention, a simulated neon light using light emitting diodes as a light source that fully satisfies the objects, aims and advantages set forth above. While the invention has been described in conjunction with a specific embodiment thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. A simulated neon light comprising:

elongated translucent diffuser having a circular cross-section;

an elongated opaque tubular housing having a lengthwise slot therein;

means for holding said diffuser in longitudinally aligned abutment against edges of said housing slot to form a chamber between said housing and said diffuser from which light may only be emitted through said diffuser;

a plurality of light emitting diodes aligned in said chamber; and means for connecting said plurality of diodes to an electrical power source for energizing said diodes.

2. A simulated neon light comprising:

an elongated translucent diffuser having a circular cross-section;

an elongated opaque tubular housing of constant cross-section having a lengthwise slot therein;

means for holding said diffuser in longitudinally aligned abutment against edges of said housing slot to form a chamber between said housing and said diffuser from which light may only be emitted through said diffuser;

a plurality of light emitting diodes aligned in a linear array in said chamber and entirely outside of said diffuser circular cross-section; and means for connecting said plurality of diodes to an electrical power source for energizing said diodes.

3. A simulated neon light comprising:

an elongated translucent diffuser having a circular cross-section;

an elongated opaque tubular housing of constant cross-section having a lengthwise slot therein, said housing having a maximum width taken in a direction parallel to a plane traversing said slot which is not greater than a diameter of said diffuser;

means for holding said diffuser in longitudinally aligned abutment against edges of said housing slot to form a chamber between said housing and said diffuser from which light may only be emitted through said diffuser;

a plurality of light emitting diodes aligned in a linear array in said chamber and entirely outside of said diffuser circular cross-section; and means for connecting said plurality of diodes to an electrical power source for energizing said diodes.

4. A light according to claim 1, said housing having a maximum width taken in a direction parallel to a plane traversing said slot which is not greater than a diameter of said diffuser.

5. A light according to claim 1, said diffuser having a lengthwise slot therein, said slot being contiguous with said housing slot.

6. A light according to claim 1, said diodes being of the same color.

7. A light according to claim 1, said diodes being electrically connected in patterns of alternating sequential activation.

8. A light according to claim 7, said diodes being color coded according to said patterns of alternating sequential activation.

9. A light source according to claim 1, said diodes being spaced from said diffuser so as to provide an appearance of substantially homogeneous light intensity across said diffuser.

10. A light according to claim 1, said holding means comprising mating channels and flanges extending lengthwise on said diffuser and said housing.

11. A light according to claim 10, said housing being sufficiently resiliently flexible to permit said diffuser to be disengaged from and reengaged with said housing.

12. A light according to claim 1, said diffuser being made of polyethylene.

13. A light according to claim 1, said polyethylene being milky clear.

14. A light according to claim 1, said diffusser being made of material having an index of refraction approximately equal to that of polyethylene.

15. A light according to claim 1, said diodes being fixed to a circuit board.

16. A light according to claim 15, said housing having channels for engagement of edges of said circuit board therein.

17. A light according to claim 16, said housing being sufficiently resiliently flexible to permit said circuit board to be disengaged from and reengaged with said housing.

18. A light according to claim 15, said housing being opposed parallel inner flanges on which said circuit board is seated.

19. A light according to claim 18, further comprising at least one spring clip cooperable with said housing to hold said circuit board against said inner flanges.

20. A light according to claim 1 further comprising a translucent colored coating on an exposed exterior surface of said diffuser.

* * * * *